US010995297B2

(12) United States Patent
Bugner et al.

(10) Patent No.: US 10,995,297 B2
(45) Date of Patent: May 4, 2021

(54) COMPOSITION FOR PROTECTION FROM SCALE AND AS LUBRICANT FOR HOT PROCESSING METALS

(71) Applicant: Chemische Fabrik Budenheim KG, Budenheim (DE)

(72) Inventors: Steffen Bugner, Budenheim (DE); Bernd Schneider, Wiesbaden (DE); Andrej Weber, Heidesheim (DE); Dirk Masurat, Eltville (DE); Nicole Patzig, Budenheim (DE)

(73) Assignee: Chemische Fabrik Budenheim KG, Budenheim (DE)

( * ) Notice: Subject to any disclaimer, the term of this patent is extended or adjusted under 35 U.S.C. 154(b) by 0 days.

(21) Appl. No.: 14/778,322

(22) PCT Filed: Mar. 11, 2014

(86) PCT No.: PCT/EP2014/054626
§ 371 (c)(1),
(2) Date: Sep. 18, 2015

(87) PCT Pub. No.: WO2014/146927
PCT Pub. Date: Sep. 25, 2014

(65) Prior Publication Data

US 2016/0215232 A1 Jul. 28, 2016

(30) Foreign Application Priority Data

Mar. 21, 2013 (DE) ..... 10 2013 102 897.7

(51) Int. Cl.

| | |
|---|---|
| ***C10M 141/02*** | (2006.01) |
| ***C10M 141/12*** | (2006.01) |
| *C10N 20/06* | (2006.01) |
| *C10N 30/02* | (2006.01) |
| *C10N 30/04* | (2006.01) |
| *C10N 30/00* | (2006.01) |
| *C10N 40/20* | (2006.01) |

(52) U.S. Cl.
CPC ..... *C10M 141/02* (2013.01); *C10M 141/12* (2013.01); *C10M 2201/041* (2013.01); *C10M 2201/084* (2013.01); *C10M 2201/085* (2013.01); *C10M 2201/087* (2013.01); *C10M 2201/102* (2013.01); *C10M 2201/12* (2013.01); *C10M 2207/122* (2013.01); *C10M 2207/125* (2013.01); *C10N 2020/06* (2013.01); *C10N 2030/02* (2013.01); *C10N 2030/04* (2013.01); *C10N 2030/70* (2020.05); *C10N 2040/242* (2020.05)

(58) Field of Classification Search
CPC ..... C10M 141/02; C10M 141/12; C10M 2201/041; C10M 2201/087; C10M 2201/084; C10M 2201/085; C10M 2201/102; C10M 2201/12; C10M 2207/122; C10M 2207/125; C10N 2230/04; C10N 2230/02; C10N 2220/082; C10N 2240/404; C10N 2230/70; C10N 2210/02; C10N 2210/01
See application file for complete search history.

(56) References Cited

U.S. PATENT DOCUMENTS

| | | | |
|---|---|---|---|
| 4,183,236 | A | 1/1980 | Spiegelberg et al. |
| 4,780,226 | A | 10/1988 | Sheets et al. |
| 5,691,282 | A | 11/1997 | Periard et al. |
| 5,895,776 | A | 4/1999 | Aurin et al. |

(Continued)

FOREIGN PATENT DOCUMENTS

| | | | |
|---|---|---|---|
| BR | 9602185 | A | 4/1998 |
| CH | 629845 | A5 | 5/1982 |
| CN | 1143107 | A | 2/1997 |

(Continued)

OTHER PUBLICATIONS

Chinese Office Action dated May 31, 2016 in co-pending Chinese patent application No. CN201480017118.3 (5 pages) and (6 pages English language translation thereof).

(Continued)

*Primary Examiner* — Taiwo Oladapo
(74) *Attorney, Agent, or Firm* — Faegre Drinker Biddle & Reath LLP

(57) ABSTRACT

A composition for protection from scale and as a lubricant for the hot processing of metals is disclosed. The composition includes a mixture of fine-powder materials containing at least the following constituents:

(a) 0 to 15% by weight of secondary or tertiary calcium phosphate compound, hydroxyapatite or a mixture thereof, (b) 0.1 to 35% by weight of fatty acid, fatty acid salt or a mixture thereof, (c) 1 to 90% by weight of ground borosilicate glass which in relation to the borosilicate glass contains Na, B, Si and Al in the following proportions by weight expressed by their respective oxides:

1 to 30% by weight of $Na_2O$, 2 to 70% by weight of $B_2O_3$, 10 to 70% by weight of $SiO_2$, and 0 to 10% by weight of $Al_2O_3$, (d) 9 to 85% by weight of condensed alkali metal phosphates, (e) boric acid, boric acid salt or a mixture thereof in an amount corresponding to a boron content, expressed by the oxide, of 0 to 3.2% by weight of $B_2O_3$, and (f) 0 to 10% by weight of graphite. The mixture has a mean particle size D50 of <300 μm.

18 Claims, No Drawings

(56) References Cited

U.S. PATENT DOCUMENTS

| | | | | |
|---|---|---|---|---|
| 2010/0298181 | A1* | 11/2010 | Bugner | C10M 169/04<br>508/158 |
| 2010/0326620 | A1 | 12/2010 | Muller et al. | |

FOREIGN PATENT DOCUMENTS

| | | | | |
|---|---|---|---|---|
| CN | 101479369 | A | 7/2009 | |
| DE | 1 290 664 | B | 3/1969 | |
| DE | 24 30 249 | A1 | 2/1976 | |
| DE | 27 51 222 | A1 | 5/1979 | |
| DE | 2751222 | A1 * | 5/1979 | B01J 3/00 |
| DE | 20 2008 017 975 | U1 | 1/2011 | |
| EP | 0 003 419 | A2 | 8/1979 | |
| EP | 0164637 | A1 | 12/1985 | |
| EP | 0 829 528 | A2 | 3/1998 | |
| WO | WO-2008/000700 | A2 | 1/2008 | |

OTHER PUBLICATIONS

Brazilian Office Action dated Nov. 19, 2019 in co-pending Brazilian patent application No. BR112015019739-6 (2 pages) and 1 page English language translation thereof.

* cited by examiner

COMPOSITION FOR PROTECTION FROM SCALE AND AS LUBRICANT FOR HOT PROCESSING METALS

CROSS REFERENCE TO RELATED APPLICATIONS

This application is a National Stage of International Application No. PCT/EP2014/054626 filed Mar. 11, 2014, which claims benefit of German Patent Application No. 10 2013 102 897.7 filed Mar. 21, 2013, both of which are herein incorporated by reference in their entirety.

SUBJECT OF THE INVENTION

The invention concerns a composition for protection from scale and as a lubricant for the hot processing of metals.

BACKGROUND OF THE INVENTION

In the hot working of metals, in particular steel, in a temperature range of 500-1300° C., such as for example in rolling or drop forging, scale formation occurs at the heated metal surface at the ambient air, and that scale formation can be pronounced to different degrees depending on the respective transfer times to the next process step. In hot rolling processes for steel for the production of seamless tubes a solid material is pierced and a hollow block is formed, which is then elongated in subsequent rolling steps. Here the danger of scale formation on the heated metal surface of the hollow block during the transfer to the elongation process is particularly high. In the subsequent rolling steps that scale formation can result in internal flaws in the seamless tube. For that reason the scale which occurs is blown out for example with compressed air or inert gas. In addition widely differing substances in powder form are applied to the inside surface of the hollow blocks as a lubricant or etching agent or scale dissolution agent. Examples of such agents contain graphite, boronitride, molybdenum sulphide, silicates, sodium salts, alkali metal sulphates, saponified fatty acids or alkaline earth metal phosphates and mixtures thereof. Alkali metal borates with different water of crystallisation or boric acid are frequently used.

In a further area of application, the forging process, in particular for large and heavy parts such as for example railway wheels, a cylindrical metal block which is preheated to >1200° C. is upset in a pre-shaping press prior to the main shaping steps of contour forging, wheel rolling and finishing forging, that is to say it is roughly pre-shaped into a disc form. Because of the relatively long residence times of the heated parts, due to the process conditions involved, secondary scale phenomena occur at the surface, and they have an adverse influence on the shaping operation as well as the quality of the surfaces of the parts. If such a metal part is coated prior to the heating operation or the first shaping step with lubricants, etching agents and scale dissolution agents of the above-mentioned kind those adverse influences are markedly reduced.

To guarantee the rapid formation of a melt for lubrication and for protection from scale the above-mentioned agents are applied to the glowing surfaces by mist spraying in the form of power or granular material. The consequence of this is that the boron compounds contained in the known agents, because of the water solubility and the difficulties involved in stopping them from spreading spatially, pass into the waste water and represent a potential danger for water sources. In addition when using boron salts and boric acid in the described application in the form of powder or granular material there is a risk of aspiration. Studies in that respect point to an impairment in fertility and danger to the child in the womb and have resulted in the boron compounds and the mixtures made up therewith being classified as reproductionally toxic. Those properties therefore represent a significant danger to people and the environment and are therefore relevant in terms of production of the power mixtures, storage, transport, handling, disposal and the actual use and purpose of those materials in metal working. A lubricant for hot working of metals, which has a high proportion of water-soluble boron compounds, is described for example in WO 2008/000700.

Many lubricants for the hot working of metals contain graphite because of its good forging properties and temperature stability. It will be noted however that graphite suffers from serious disadvantages like for example the absorption of graphite carbon into the worked metal surface, whereby the composition and properties of the metal surface can be altered. In addition graphite is undesirable for reasons relating to working hygiene as graphite powder is easily atomised into the ambient atmosphere and represents a risk of slipping for people working in the proximity. In addition the graphite dust can put at risk the operability of electrical equipment in operation thereof. It would therefore be desirable to provide a lubricant without graphite or with a proportion of graphite which is as low as possible, with at the same time a good lubrication action.

In addition many known lubricants, because of their physical properties and grain sizes, do not have a good free-flowing or flow behaviour. A coarse material with large grain sizes frequently results in inadequate and irregular coating of the metal surface and thus poor reduction in scale. A finer grain size would therefore have the advantage that better layer formation can be achieved. Known fine-grain materials with small grain sizes, for example below 50 μm, frequently tend however to lump formation, in particular upon storage, for which reason it is only with difficulty that they can be sprayed in powder form on to the metal surface, which again nullifies the advantage of a fine grain size of known compositions.

OBJECT OF THE INVENTION

The object of the present invention was therefore that of providing a composition for the hot processing of metals, that acts as a protection from scale and as a lubricant, in which the risk potential due to the boron compounds used hitherto as constituents is reduced in comparison with the state of the art, which has a good free-flowing and flow behaviour and which has good properties in regard to scale dissolution on heated metal surfaces and lubrication and which when applied in powder form allows a good coating on the metal surface and requires as little graphite as possible or none at all.

DESCRIPTION OF THE INVENTION

According to the invention that object is attained by a composition for protection from scale and as a lubricant for the hot processing of metals, comprising a mixture of fine-powder materials, wherein the mixture contains at least the following constituents:

(a) 0.5 to 10% by weight of secondary or tertiary calcium phosphate compound, hydroxyapatite or a mixture thereof, (b) 1 to 35% by weight of fatty acid, fatty acid salt or a mixture thereof, (c) 1 to 80% by weight of ground borosilicate glass which in relation to the borosilicate glass contains Na, B, Si and Al in the following proportions by weight expressed by their respective oxides:

1 to 30% by weight of $Na_2O$, 2 to 70% by weight of $B_2O_3$, 10 to 70% by weight of $SiO_2$, and 0 to 10% by weight of $Al_2O_3$, (d) 40 to 85% by weight of condensed alkali metal phosphates, (e) boric acid, boric acid salt or a mixture thereof in an amount corresponding to a boron content, expressed by the oxide, of 0 to 3.2% by weight of $B_2O_3$, and (f) not more than 10% by weight of graphite, wherein the mixture has a mean particle size D50 of ≤300 μm, measured in accordance with the method as set forth in the description under the heading "Particle size determination".

It will be appreciated that the lubricant according to the invention can contain further constituents insofar as they do not substantially detrimentally influence the desired advantageous properties.

It was surprisingly found that the composition according to the invention is highly suitable as an agent for protection from scale and as a lubricant for the hot processing of metals although it does not have any proportion of borates or boric acid, or an optional proportion thereof which is only very slight in comparison with known borate-based lubricants. The proportion of easily water-soluble borates which entail a high risk potential for humans and the environment is considerably reduced in comparison with known agents in the composition according to the invention or in the best-case scenario is even completely eliminated. When applied to hot metal surfaces the composition according to the invention forms the desired melt more quickly than when using known lubricants and provides for good lubrication and good protection from scale. That is achieved by the combination according to the invention of the constituents, in which respect it was surprising that the demands on lubrication and protection from scale of the composition could be achieved in spite of the proportion of ground borosilicate glass and the small proportion of boric acid or borate.

A particular advantage of the composition according to the invention lies in solubility of the borate component, which is markedly reduced in comparison with the state of the art, with a comparable or even better effectiveness and functionality. That reduced solubility of the borate component is achieved by a low or no proportion of boric acid and/or boric acid salt in accordance with constituent (e) and can further be influenced by a variation in the ratio of the proportion of fatty acid and/or fatty acid salt in accordance with constituent (b) to boric acid and/or boric acid salt in accordance with constituent (e). The proportion of borate in the ground borosilicate glass is extremely poorly water-soluble. An advantage of the composition according to the invention is therefore that, because of the low level of borate solubility, the user can more easily comply with the usually high requirements of the applicable waste water directives, for example in accordance with EN ISO 11885:2007.

In a further preferred embodiment of the invention the composition has a hemisphere temperature >400° C. The hemisphere temperature is reached when a test body in testing the ash fusion characteristic in a heating microscope approximately reaches the shape of a hemisphere. A hemisphere temperature >400° C. of the composition according to the invention has the advantage that the melting point of the composition is not reached too early and a viscosity suited to the application is retained. If the hemisphere temperature of the composition is below 400° C. the viscosity of the melt in the region of use of 600-1300° C. is excessively low and a sufficient melt film is not achieved.

Secondary and/or tertiary calcium phosphate compounds have surprisingly been found to be particularly suitable free-flow aid additives in a composition of the kind according to the invention for the hot processing of metals. Monocalcium phosphate is unsuitable as with humidity in the air it leads to lump formation.

In a preferred embodiment of the invention the calcium phosphate compound (a) is selected from hydroxyapatite [$Ca_5(PO_4)_3OH$] and tricalcium phosphate [$Ca_3(PO_4)_2$], hydroxyapatite being particularly preferred.

In a further preferred embodiment of the invention the calcium phosphate compound (a) is contained in the composition in an amount of 1 to 5% by weight.

The composition according to the invention further includes a fatty acid, a fatty acid salt or a mixture thereof in combination with the other constituents. It has surprisingly been found that the use of a fatty acid or a fatty acid salt considerably reduces lump formation in respect of the fine-grain powder and storage resistance can be improved. Without the applicant feeling themselves to be thereby bound to a theory it is assumed that the fatty acid or the fatty acid salt is deposited on the grains of one or more further constituents of the mixture and in that way lump formation of the grains is prevented or reduced, moisture is kept away from the grains and as a result storage resistance as well as free-flowing or flow behaviour of the lubricant is improved. It is also assumed that the fatty acid or the fatty acid salt improves the lubrication effect by virtue of decomposition in the region of use of 600-1300° C. and the formation of a gas cushion.

In a further preferred embodiment of the invention the fatty acid or the fatty acid salt (b) is selected from saturated and unsaturated fatty acids having 6 to 26 carbon atoms or salts thereof, preferably from capric acid, caprylic acid, caprinic acid, lauric acid, myristic acid, palmitic acid, margaric acid, stearic acid, arachic acid, behenic acid, lignoceric acid, cerotic acid, palmitoleic acid, oleic acid, elaidic acid, vaccenic acid, icosenic acid, erucic acid, nervonic acid, linoleic acid, linolenic acid, arachidonic acid, timnodonic acid, clupanodonic acid and salts thereof, provided that the fatty acid or the fatty acid salt is in the form of a solid at a temperature >30° C. Particularly preferably the fatty acid or the fatty acid salt is stearic acid or salts thereof.

In a further preferred embodiment of the invention the fatty acid or the fatty acid salt (b) is contained in the mixture in an amount of 1 to 15% by weight, preferably 1 to 10% by weight, particularly preferably 3 to 7% by weight.

In a further preferred embodiment of the invention the ground borosilicate glass (c) has a grain with a mean particle size D50 of ≤300 μm. The ground borosilicate glass improves uniform distribution of the composition on the hot metal surface and reduces scaling. At the high temperatures involved in metal processing the composition forms a melt, wherein the borosilicate glass improves the rapid formation of the melt and ensures same over a wider temperature range than with known lubricants. If the mean particle size of the ground borosilicate glass in the composition is excessively great the formation of the required melt can take too long, after application of the composition, which is a disadvantage.

In a further preferred embodiment of the invention the borosilicate glass (c) is contained in the mixture in an amount of 3 to 80% by weight, particularly preferably 5 to 15% by weight.

In a further preferred embodiment of the invention the condensed alkali metal phosphates (d) are selected from condensed sodium or potassium phosphates or mixtures thereof, preferably from polyphosphates and/or pyrophosphates and/or metaphosphates or mixtures thereof, particularly preferably disodium pyrophosphate [$Na_2H_2P_2O_7$], trisodium pyrophosphate [$Na_3HP_2O_7$], tetrasodium pyrophosphate [$Na_4P_2O_7$], sodium tripolyphosphate [$Na_5P_3O_{10}$], sodium trimetaphosphate [$(NaPO_3)_3$], sodium polyphosphate [$(NaPO_3)_n$], dipotassium pyrophosphate [$K_2H_2P_2O_7$], tripotassium pyrophosphate [$K_3Hp_2O_7$], tetrapotassium pyrophosphate [$K_4P_2O_7$], potassium tripolyphosphate [$K_5P_3O_{10}$], potassium trimetaphosphate [$(KPO_3)_3$] and potassium polyphosphate [$(KPO_3)_n$] or mixtures thereof, wherein constituent (d) is most preferably sodium tripolyphosphate [$K_5P_3O_{10}$].

It has been found that the use of a polyphosphate and/or a pyrophosphate and/or a metaphosphate in the mixture of the composition according to the invention advantageously contributes inter alia to scale dissolution.

In a further preferred embodiment of the invention the condensed alkali metal phosphates (d) are contained in the mixture in amount of 40 to 80% by weight, preferably 40 to 75% by weight.

In a further preferred embodiment of the invention the constituent (e) of the composition according to the invention, if included, is selected from boric acid [$H_3BO_3$], borax [$Na_2B_4O_5(OH)_4.8H_2O$ or $Na_2B_4O_7.10H_2O$], sodium borates like $Na_2B_4O_7.5H_2O$, $Na_2B_4O_7$ (water-free), sodium metaborate [$NaBO_2.4H_2O$] and boric acid anhydride [$B_2O_3$] and mixtures thereof.

In a further preferred embodiment of the invention the mixture has a mean particle size D50 of ≤250 μm, preferably ≤200 μm. Due to the small mean particle size of the constituents of the mixture according to the invention the free-flowing and flow characteristic of the composition according to the invention is considerable improved in relation to known lubricants, spraying on to surfaces in powder form is facilitated and better and more regular layer formation or coating on the metal surface is guaranteed. At the same time the combination of the constituents according to the invention of the mixture prevents or reduces lumping which in the case of lubricants according to the state of the art with small grain sizes regularly occurred and resulted in serious disadvantages.

In a further preferred embodiment of the invention the mixture has a mean particle size D50 of ≥3 μm, preferably ≥10 μm, particularly preferably ≥15 μm. It has been found that excessively small mean particle sizes on the one hand can only be produced with great difficulty and at comparatively high cost while on the other hand they also increase the tendency to lump formation again. A mean particle size in the region of 20 to 50 μm has therefore proven to be the optimum.

The invention also embraces the use of the composition according to the invention for protection from scale and as a lubricant in the hot processing of metals, wherein the composition is applied in powder form to the metal, preferably being blown thereunto. In contrast to the agents frequently used in the form of granular material for the hot processing of metals the composition according to the invention is distinguished by more stable storage properties, faster melting upon contact with the hot workpiece by virtue of the larger surface area, better suitability for being blown on and more uniform distribution on the surface of the workpiece as well as more reliable and more economical metering. In comparison with the also known use of such agents in the form of suspensions, for example in water, the dry use in powder form of the composition according to the invention affords the advantage that no unwanted cooling of the workpiece occurs due to the fluid and the additional working step of preparing the suspension for use thereof is also unnecessary.

Storage Characteristics, Agglomerate Formation and Moisture Absorption

To test the tendency to lump formation under production conditions, storage tests were carried out with various mixtures under production conditions. For that purpose a 150 g sample was stored in a climatic exposure test cabinet (type 3821/15 from Feutron) at a constant 30° C. and 80% relative air humidity for 0 h, 67 h and 96 h and then its agglomerate formation (free-flow capability) was determined in a sieve test and its moisture absorption was determined on the basis of the increase in weight in comparison with the original weighing.

It is only an overall assessment of combined storage and free-flowing characteristics of a respective mixture that makes it possible to provide information about their quality and suitability under production conditions.

Particle Size Determination

The operation of determining the mean particle size of the mixture or the constituents of the composition according to the invention is effected by means of a Cilas model 715/920 laser granulometer from Cilas US Inc. An about 80 mg sample was suspended in propan-2-ol and measurement was effected a minute after production of the suspension in accordance with the manufacturer instructions.

EXAMPLES

Table 1 hereinafter sets forth compositions according to the invention for protection from scale and as a lubricant for the hot processing of metals as well as comparative compositions. Table 2 sets forth parameters of the compositions set forth in Table 1.

TABLE 1

| Composition | | | | | | |
|---|---|---|---|---|---|---|
| | | Compositions (Proportions of the components in % by wt | | | | |
| Comp. | Constituents | E1 (Inv.) | E2 (Inv.) | E3 (Inv.) | V1 (Comp.) | V2 (Comp.) |
| (a) | Ca-phosphate compound Hydroxyapatite [$Ca_5(pO_4)_3OH$] | 4 | 5 | 5 | 0 | 5 |

TABLE 1-continued

| Composition | | | | | | |
|---|---|---|---|---|---|---|
| | | Compositions (Proportions of the components in % by wt | | | | |
| Comp. | Constituents | E1 (Inv.) | E2 (Inv.) | E3 (Inv.) | V1 (Comp.) | V2 (Comp.) |
| (b) | Fatty acid, fatty acid salt | 7 | 5 | 5 | 0 | 5 |
| | Magnesium stearate | | | | | |
| | Na/K soap | 0 | 0 | 0 | 25 | 0 |
| (c) | ground borosilicate glass[1)] | 15 | 6 | 15 | 0 | 0 |
| (d) | Condensed alkali metal phosphate | 71 | 80 | 75 | 0 | 75 |
| | Sodium tripolyphosphate | | | | | |
| (e) | Boric acid, boric acid salt | 3 | 4 | 0 | 0 | 15 |
| | Sodium tetraborate anhydride | | | | | |
| | Sodium tetraborate decahydrate | 0 | 0 | 0 | 40 | 0 |
| (f) | Graphite | 0 | 0 | 0 | 0 | 0 |
| | Sodium sulphate | 0 | 0 | 0 | 35 | 0 |
| | Total | 100 | 100 | 100 | 100 | 100 |

[1)]Composition of the ground borosilicate glass (comp. c): 20% by wt $Na_2O$, 40% by wt $SiO_2$, 38% by wt $B_2O_3$, 2% by wt $Al_2O_3$

TABLE 2

| Properties of the compositions according to Table 1 | | | | | |
|---|---|---|---|---|---|
| | Composition | | | | |
| Property | E1 (Inv.) | E2 (Inv.) | E3 (Inv.) | V1 (Comp.) | V2 (Comp.) |
| $B_2O_3$ content in component (e) | 2% | 3% | 0% | 25% | 6% |
| Required use amount | 60-120 g/m$^2$ | 60-120 g/m$^2$ | 60-120 g/m$^2$ | 200-300 g/m$^2$ | 60-120 g/m$^2$ |
| Scale dissolution characteristic | very good | very good | very good | very good | very good |
| Viscosity of the melt | high | high | medium | high | high |
| Quality of the inner tubes | very good | very good | very good | very good | very good |
| Hemisphere temperature | 750° C. | 765° C. | 735° C. | non-determinable | 775° C. |
| Particle size D50 of the mixture | 60 μm | 60 μm | 60 μm | 130 μm | 60 μm |
| Water solubility $B_2O_3$ (10% mixture in water; 25° C.) | 0.4% | 0.3% | 410 ppm | 1.9% | 1.0% |
| Storage stability | very good | very good | very good | adequate | very good |
| Free-flow capability | very good | very good | very good | poor | very good |
| Bulk weight | 700-900 g/l | 700-900 g/l | 700-900 g/l | 1000-1200 g/l | 700-900 g/l |

The "required use amount" stated in Table 2 is defined as the amount in "g" which on average is introduced into the hollow blocks to be processed by means of a suitable application technology, for example using the usual injector technology (blowing-in), in relation to the internal surface area of the workpiece to be coated (hollow block) in "m$^2$".

The properties scale dissolution characteristic, quality of the inner tubes, storage stability and free-flow capability are classified on the basis of a five-stage evaluation scale with the evaluation options "very good", "good", "satisfactory", "adequate" and "poor" and the viscosity of the melt was classified on the basis of a 3-stage evaluation scale with the evaluations "high", "medium" and "low".

The invention claimed is:

1. A composition for protection from scale and as a lubricant for the hot processing of metals, comprising a mixture of fine-powder materials, wherein the mixture contains at least the following constituents:

(a) 0.5 to 10% by weight of secondary or tertiary calcium phosphate compound, hydroxyapatite or a mixture thereof;

(b) 1 to 35% by weight of fatty acid salt;

(c) 1 to less than 58.5% by weight of ground borosilicate glass which in relation to the borosilicate glass contains Na, B, Si and Al in the following proportions by weight expressed by their respective oxides:

1 to 30% by weight of $Na_2O$, 2 to 70% by weight of $B_2O_3$, 10 to 70% by weight of $SiO_2$, and 0 to 10% by weight of $Al_2O_3$;

(d) 40 to 85% by weight of condensed alkali metal phosphates;

(e) $Na_2B_4O_7$ anhydride in an amount, if converted to $B_2O_3$, of greater than 0 but not more than 3.0% by weight of $B_2O_3$, wherein the total amount of $Na_2B_4O_7$ anhydride, boric acid and boric acid salt, if converted to $B_2O_3$, is not more than 3.0% by weight of $B_2O_3$; and (f) not more than 10% by weight of graphite, wherein the mixture has a mean particle size D50 of ≤300 μm, measured in accordance with the method as set forth in the description under the heading "Particle size determination".

2. The composition according to claim 1, wherein the mixture contains not more than 5% by weight of graphite.

3. The composition according to claim 1, wherein the secondary or tertiary calcium phosphate compound (a) is selected from the group consisting of hydroxyapatite [$Ca_5(PO_4)_3OH$] and tricalcium phosphate [$Ca_3(PO_4)_2$].

4. The composition according to claim 1, wherein the secondary or tertiary calcium phosphate compound (a) is contained in the mixture in an amount of 1 to 5% by weight.

5. The composition according to claim 1, wherein the fatty acid or the fatty acid salt (b) is selected from the group consisting of saturated and unsaturated fatty acids having 6 to 26 carbon atoms and salts thereof, provided that the fatty acid or the fatty acid salt is in the form of a solid at a temperature >30° C.

6. The composition according to claim 1, wherein the fatty acid or the fatty acid salt (b) is contained in the mixture in an amount of 1 to 15% by weight.

7. The composition according to claim 1, wherein the ground borosilicate glass (c) has a grain with a mean particle size D50 of ≤300 μm.

8. The composition according to claim 1, wherein the ground borosilicate glass (c) is contained in the mixture in an amount of 3 to 58.5% by weight.

9. The composition according to claim 1, wherein the condensed alkali metal phosphates (d) are selected from the group consisting of condensed sodium and potassium phosphates and mixtures thereof.

10. The composition according to claim 1, wherein the condensed alkali metal phosphates (d) are contained in the mixture in amount of 40 to 80% by weight.

11. The composition according to claim 1, wherein the mixture has a mean particle size D50 of ≤250 μm.

12. The composition according to claim 1, wherein the mixture has a mean particle size D50 of ≥3 μm.

13. A method comprising applying the composition according to claim 1 in powder form to a material for protection from scale and as a lubricant in the hot processing of metals.

14. A composition for protection from scale and as a lubricant for the hot processing of metals, comprising a mixture of fine-powder materials, wherein the mixture contains at least the following constituents:

(a) 1 to 5% by weight of tricalcium phosphate compound, hydroxyapatite or a mixture thereof;

(b) 3 to 7% by weight of stearic acid salt;

(c) 5 to 15% by weight of ground borosilicate glass which in relation to the borosilicate glass contains Na, B, Si and Al in the following proportions by weight expressed by their respective oxides:
1 to 30% by weight of $Na_2O$,
2 to 70% by weight of $B_2O_3$,
10 to 70% by weight of $SiO_2$, and
0 to 10% by weight of $Al_2O_3$;

(d) 40 to 80% by weight of condensed sodium or potassium polyphosphates;

(e) $Na_2B_4O_7$ anhydride in an amount, if converted to $B_2O_3$, of greater than 0 but not more than 3.0% by weight of $B_2O_3$, wherein the total amount of $Na_2B_4O_7$ anhydride, boric acid and boric acid salt, if converted to $B_2O_3$, is not more than 3.0% by weight of $B_2O_3$; and (f) not more than 10% by weight of graphite, wherein the mixture has a mean particle size D50 of ≤300 μm, measured in accordance with the method as set forth in the description under the heading "Particle size determination".

15. A composition for protection from scale and as a lubricant for the hot processing of metals, comprising a mixture of fine-powder materials, wherein the mixture contains at least the following constituents:

(a) 4 to 5% by weight of hydroxyapatite;

(b) 5 to 7% by weight of magnesium stearate;

(c) 5 to 15% by weight of ground borosilicate glass which in relation to the borosilicate glass contains Na, B, Si and Al in the following proportions by weight expressed by their respective oxides:
1 to 30% by weight of $Na_2O$,
2 to 70% by weight of $B_2O_3$,
10 to 70% by weight of $SiO_2$, and
0 to 10% by weight of $Al_2O_3$;

(d) 70 to 80% by weight of condensed sodium or potassium polyphosphates; and (e) $Na_2B_4O_7$ anhydride in an amount, if converted to $B_2O_3$, of greater than 0 but not more than 3.0% by weight of $B_2O_3$, wherein the total amount of $Na_2B_4O_7$ anhydride, boric acid and boric acid salt, if converted to $B_2O_3$, is not more than 3.0% by weight of $B_2O_3$; and (f) not more than 10% by weight of graphite, wherein the mixture has a mean particle size D50 of ≤300 μm, measured in accordance with the method as set forth in the description under the heading "Particle size determination".

16. The composition according to claim 1, wherein the ground borosilicate glass (c) is contained in the mixture in an amount of 1 to 56.5% by weight, and wherein the $Na_2B_4O_7$ anhydride (e) is contained in the mixture in an amount, if converted to $B_2O_3$, of from 2.0 to 3.0% by weight of $B_2O_3$, wherein the total amount of $Na_2B_4O_7$ anhydride, boric acid and boric acid salt, if converted to $B_2O_3$, is in the range of from 2.0 to 3.0% by weight of $B_2O_3$.

17. The composition according to claim 14, wherein the $Na_2B_4O_7$ anhydride (e) is contained in the mixture in an amount, if converted to $B_2O_3$, of from 2.0 to 3.0% by weight of $B_2O_3$, wherein the total amount of $Na_2B_4O_7$ anhydride, boric acid and boric acid salt, if converted to $B_2O_3$, is in the range of from 2.0 to 3.0% by weight of $B_2O_3$.

18. The composition according to claim 15, wherein the $Na_2B_4O_7$ anhydride (e) is contained in the mixture in an amount, if converted to $B_2O_3$, of from 2.0 to 3.0% by weight of $B_2O_3$, wherein the total amount of $Na_2B_4O_7$ anhydride, boric acid and boric acid salt, if converted to $B_2O_3$, is in the range of from 2.0 to 3.0% by weight of $B_2O_3$.

* * * * *